US006088854A

United States Patent [19]

Brownrigg

[11] Patent Number: 6,088,854

[45] Date of Patent: Jul. 18, 2000

[54] LATERAL BODY-SUPPORTING PILLOW

[76] Inventor: Elizabeth Ann Brownrigg, 5511 Charlestown Dr., Dallas, Tex. 75230

[21] Appl. No.: 09/107,264

[22] Filed: Jun. 30, 1998

Related U.S. Application Data

[60] Provisional application No. 60/051,485, Jul. 1, 1997.

[51] Int. Cl.[7] ..... A47C 20/00

[52] U.S. Cl. ..... 5/632; 5/652; 5/657

[58] Field of Search ..... 5/655, 652, 657, 5/484, 952, 487, 632; 446/369; D6/601, 598; D21/657

[56] References Cited

U.S. PATENT DOCUMENTS

| | | | |
|---|---|---|---|
| D. 371,600 | 7/1996 | Henry | D23/386 |
| D. 377,815 | 2/1997 | Deprima | D21/168 |
| 2,720,660 | 10/1955 | Smith | 5/337 |
| 2,777,440 | 1/1957 | Baker | 128/69 |
| 3,899,797 | 8/1975 | Gunst | 5/657 X |
| 4,173,048 | 11/1979 | Varaney | 5/436 |
| 4,350,152 | 9/1982 | Strakowski | 128/24 |
| 4,505,687 | 3/1985 | Munro | 446/368 |
| 4,624,021 | 11/1986 | Hofstetter | 5/431 |
| 4,754,510 | 7/1988 | King | 5/431 |
| 4,761,872 | 8/1988 | Buettner et al. | 5/636 X |
| 4,999,866 | 3/1991 | Lindsey | 5/417 |
| 5,064,613 | 11/1991 | Higgs et al. | 422/16 |
| 5,097,551 | 3/1992 | Smith | 5/652 |
| 5,371,909 | 12/1994 | McCarty | 5/655 |
| 5,544,377 | 8/1996 | Gostine | 5/630 |
| 5,545,199 | 8/1996 | Hudson | 5/644 X |
| 5,573,014 | 11/1996 | Ginter | 128/845 |
| 5,586,351 | 12/1996 | Ive | 5/655 |

FOREIGN PATENT DOCUMENTS

| | | | |
|---|---|---|---|
| 4237782-A1 | 5/1993 | Germany | 5/655 |

*Primary Examiner*—Terry Lee Melius
*Assistant Examiner*—Rodrigo J. Morales
*Attorney, Agent, or Firm*—John Glenn Meazell

[57] ABSTRACT

The present embodiment is a pillow designed to support various portions of the body either in the prone or sitting position. The current embodiment primarily comprises a singular hollow flexible tube filled with a malleable substance allowing flexibility at all points along the tube and having sufficient firmness to provide support for the desired portion of the body.

4 Claims, 3 Drawing Sheets

LATERAL BODY-SUPPORTING PILLOW

This application is filed in connection with the provisional application No. 60/051,485 filed on Jul. 1, 1997.

BACKGROUND

Patients who spend extended periods of time in medical facilities in the prone or sitting position often experience extreme discomfort either from the medical procedures conducted on them or the length of stay necessitated by their medical conditions. This discomfort is oftentimes lessened by the introduction of pillows to support the body at strategic points. The current state of the art for medical professionals is to utilize numerous flat pillows placed at the point of need. In order to effectuate this practice the medical professionals must roll, twist and fold flat pillows and place them at the strategic locations to alleviate the suffering.

The aforementioned procedure of utilizing numerous pillows results in significant labor expense, storage expense and equipment expense in connection with providing this necessary procedure.

In order to support the body the medical professional generally must use four to six pillows. In addition, every pillow used by a patient must be purchased by the patient. Therefore, the patient must use and purchase numerous pillows for this procedure. The Lateral Body Supporting Pillow is designed to replace the necessity of using numerous pillows. As a result, the cost of the Lateral Body Supporting Pillow versus the cost of the number of pillows necessary under the conventional method is smaller. Therefore, patient and medical providers experience cost savings in connection with the equipment expense.

Under the conventional method, the medical provider must roll, twist or fold the pillow in order to support the body. The time required to perform this act multiplied by the number of pillows is substantial. Furthermore, the pillows oftentimes unroll upon the patient's movements, thereby requiring additional time by the medical professional to reroll, re-twist and refold the flat pillows. The Lateral Body Supporting Pillow does not need to be rolled, twisted or folded in order to provide the desired support as it is already formed to provide the support. Therefore, use of the Lateral Body Supporting Pillow eliminates significant time expense by medical professionals in the course of this procedure.

Due to the patient's requirement of this number of pillows, the medical provider must dedicate substantial storage space to store these pillows. The Lateral Body Supporting Pillow alleviates the need for this amount of storage space by replacing the six pillows with one. The Lateral Body Supporting Pillow contains less volume than the equivalent number of flat pillows necessary to provide the support. Furthermore, the present embodiment folds easily and retains its shape after being folded. Therefore, the present embodiment lessens the necessity of dedicating critical storage space in order to meet the needs of a medical provider's patients.

In addition to providing comfort to the patient, the present embodiment provides comfort and support to visitors during the patient's stay. Specifically, the visitor will spend substantial amounts of time in the sitting position while visiting the patient. The present invention provides comfort and support for the visitor by providing added support in the chair which the visitor uses while visiting. The visitor will also use the chair, although not designed for such use, in which to sleep. The present embodiment provides added support of the visitor for the neck, head, and side region of the body, thereby creating a more hospitable environment in which to sleep. The present invention alleviates the discomfort for both the visitor and the patient by providing support in the neck region, the shoulder regions, the sides and the hips.

In addition to supporting the patient's body for comfort, the Lateral Body Supporting Pillow may be used in connection with therapy provided to paralyzed patients. The Lateral Body Supporting Pillow may be used to support and hold the patient in a certain position while a medical professional conducts therapy on the patient.

The Lateral Body Supporting Pillow may be used to assist the support of the aged while utilizing a wheel chair or otherwise. A wheel chair is not designed for comfort but rather for utilitarian reasons. As a result, the chair provides little padding or support in aged areas of need. The Lateral Body Supporting Pillow may be used to support the neck, shoulders and head while simultaneously cushioning the older patient's bones against the hard surfaces of the wheel chair.

This present embodiment forgoes the necessity of using numerous flat pillows to provide the support desired. The Lateral Body Supporting Pillow further alleviates the necessity of time in order to roll, mold and conform flat pillows to the desired thickness and firmness. Instead the Lateral Body Supporting Pillow is integral in design to provide support in all desired areas without the necessity of using numerous pillows. Furthermore, the Lateral Body Supporting Pillow is designed for adequate firmness and thickness. The current embodiment cures the problem described above and has been demonstrated to reduce time, labor, storage and equipment expenses by replacing the conventional method using multiple flat pillows.

SUMMARY

The present embodiment is directed toward an apparatus that satisfies the need for reducing the number of pillows necessary to provide the comfort and support of a patient or visitor while either undergoing medical procedures, extended stays in the hospital, or visiting for substantial periods of time. An object of the present embodiment is to reduce the equipment costs of providing numerous pillows.

Another object of the present embodiment is to reduce the time expense of having to roll, twist or fold the pillows to provide the support desired.

Another object of the present embodiment is to reduce the additional time of having to re-roll the pillows when said patient moves thereby causing flat pillows to unroll.

Another object of the invention is to free up or reduce costly storage space in the hospital necessitated by patient and visitor pillow requirements.

Another object of the present embodiment is to provide a single pillow with a diameter and malleability sufficient to provide support.

Another object of the present embodiment is to prevent the support from rolling out.

Another object of the present embodiment is to assist the medical professional in placing paralyzed patients in static position in order to treat them.

Other objects and advantages of the present embodiment will become apparent and readily illustrative of such embodiment.

DRAWINGS

DESCRIPTION

The present embodiment consists of a hollow cylindrical shell 4 that is filled with a malleable material 3.

The hollow cylindrical shell 4 is made of cloth, preferably cotton, or some other flexible material. The malleable material 3 is solid and the preferred embodiment is a polyester fiber having antimicrobial antibacterial properties. However, the malleable material 3 may not necessarily have the antimicrobial antibacterial properties.

Figure 1:
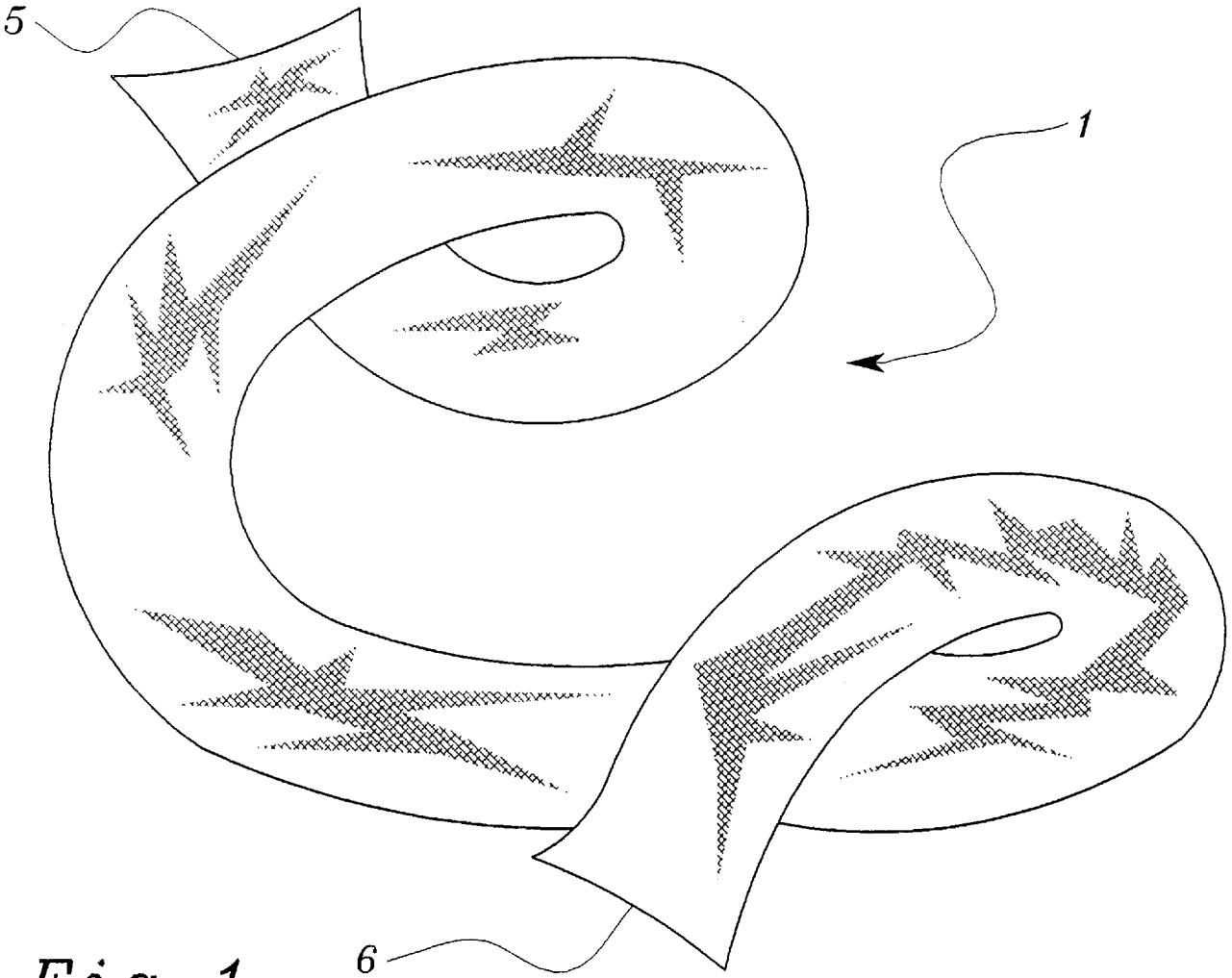
FIG. 1 is a top perspective view.
Figure 2:
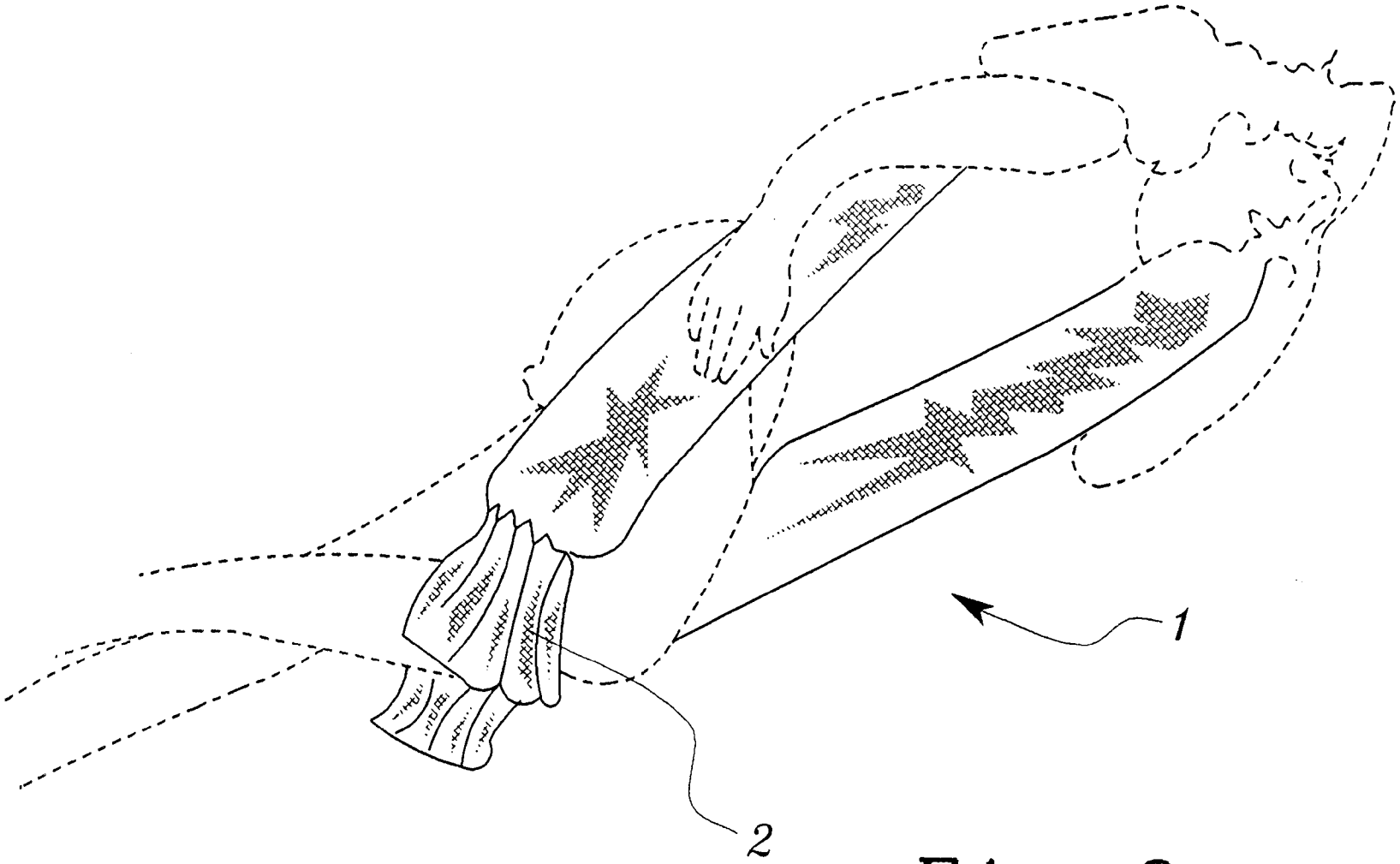
FIG. 2 is a side perspective view.
Figure 4:
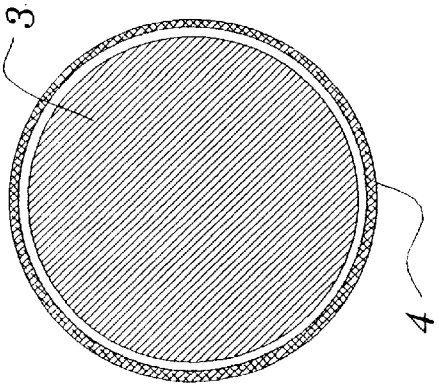
FIG. 4 is a cross sectional view.
Figure 3:
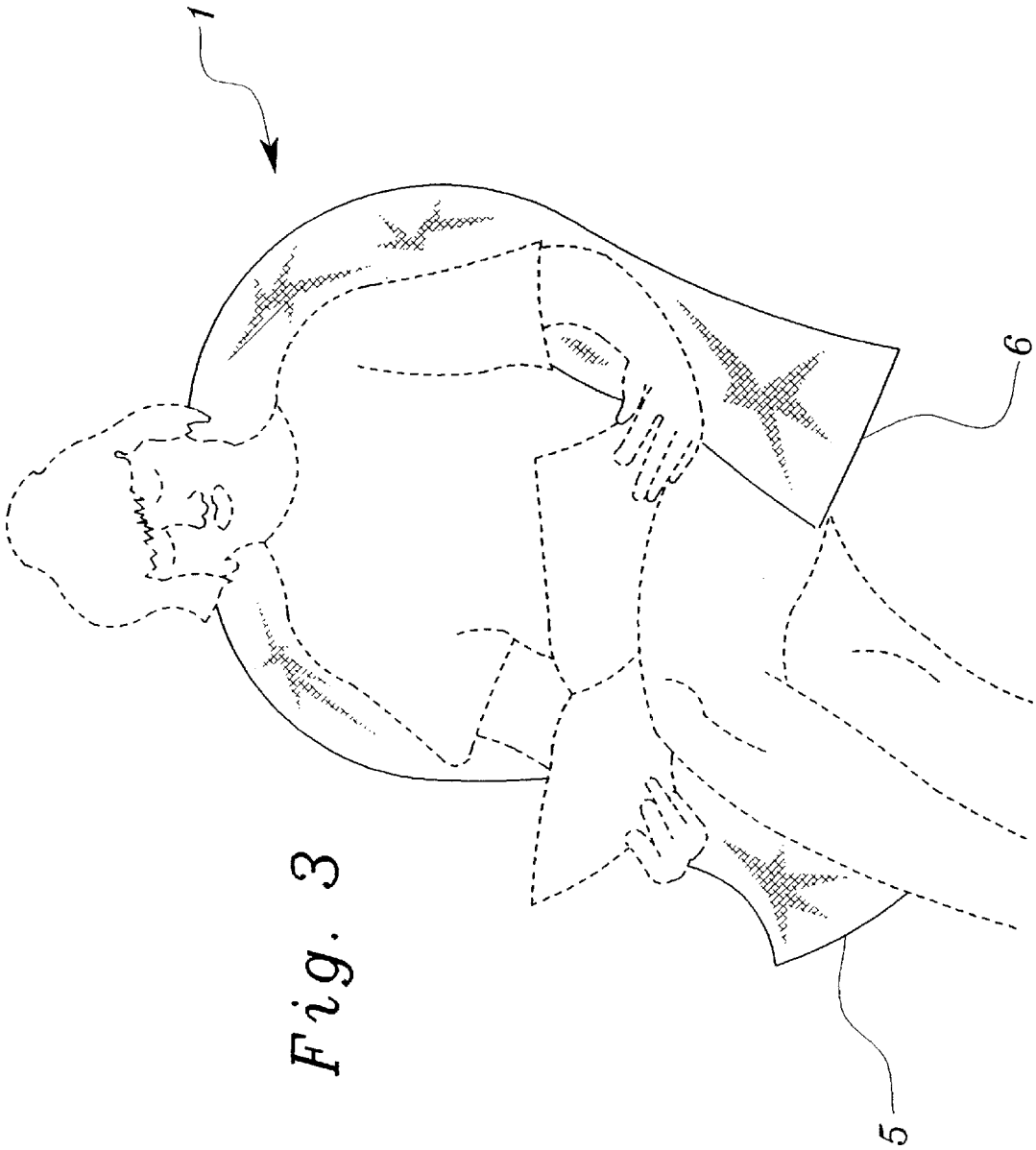
FIG. 3 is a frontal perspective view.

The ends 5, 6 are closed either by stitching or some alternative method of closing the ends 5, 6. However, the ends 5, 6 may be gathered as shown in FIG. 2.

The Lateral Body Supporting Pillow 1 is between 75 inches and 110 inches in length and has diameter of between 3 inches and 6 inches.

The firmness of the preferred embodiment is obtained by blowing between 52 ounces and 58 ounces of polyester fiber in a 100 inch Lateral Body Supporting Pillow having a diameter of 4.5 inches. The firmness of the preferred embodiment is also obtained by blowing between 42 ounces and 46 ounces of polyester fiber in a 78 inch Lateral Body Supporting Pillow having a diameter of 4.5 inches.

The present embodiment is used by placing the centermost portion of the Lateral Body Supporting Pillow 1 under the neck of the user and bending the loose ends 5, 6 downward under the shoulders of the user, and if desired, under the rib cage of the user, the thighs of the user, the hips of the user and buttocks of the user.

The loose ends 5, 6 of the Lateral Body Supporting Pillow 1 may be place where it is desired to achieve the greatest comfort to the user.

When the Lateral Body Supporting Pillow 1 is placed around the neck, the Lateral Body Supporting Pillow 1 is less likely to extract itself from the supporting position in which it is placed due to the constraining forces emanating from the neck region.

I Claim:

1. A Lateral Body-Supporting Pillow comprising:

a hollow cylindrical shell having two ends, said hollow cylindrical shell having a length of between seventy-five (75) inches and one hundred ten (110) inches and a diameter of 4.5 inches;

a malleable material comprised of polyester fiber inserted substantially uniformly within said hollow cylindrical shell; said malleable material comprised of polyester fiber having a density between 0.0327 ounces/in$^3$ and 0.0371 ounces/in$^3$.

2. The Lateral Body-Supporting Pillow as described in claim 1 wherein the malleable material having antibacterial properties.

3. The Lateral Body-Supporting Pillow as described in claim 1 wherein the malleable material having antimicrobial properties.

4. The Lateral Body-Supporting Pillow as described in claim 1 wherein said hollow cylindrical shell comprised of cotton.

* * * * *